US005551774A

United States Patent [19]

Campbell et al.

[11] Patent Number: 5,551,774

[45] Date of Patent: Sep. 3, 1996

[54] FOOD BAR WITH MODULAR SUPPORT SYSTEM

[75] Inventors: Argyle Campbell, Newport Beach; Larry D. Maddux, Westminster, both of Calif.

[73] Assignee: Cambro Manufacturing Company, Huntington Beach, Calif.

[21] Appl. No.: 321,742

[22] Filed: Oct. 12, 1994

[51] Int. Cl.[6] ..... A47G 19/26

[52] U.S. Cl. ..... 312/284; 312/114; 312/140.4

[58] Field of Search ..... 312/284, 114, 312/116, 126, 127, 137, 229, 140.4, 196; 108/25, 26, 61; 248/172, 670; 186/45, 47; 206/45.11, 45.14; 220/510, 528, 552

[56] References Cited

U.S. PATENT DOCUMENTS

| | | | |
|---|---|---|---|
| 803,102 | 10/1905 | Harris | 312/126 X |
| 1,626,330 | 4/1927 | Cossins | 312/114 |
| 2,201,265 | 5/1940 | Hill | 312/126 X |
| 2,584,755 | 2/1952 | Stewart | 312/137 X |
| 2,894,604 | 7/1959 | McMillan | 312/137 X |
| 3,038,986 | 6/1962 | Molitor | 312/114 X |
| 3,130,288 | 4/1964 | Monaco et al. | 312/284 X |
| 3,162,495 | 12/1964 | Swift | 108/25 X |
| 3,184,095 | 5/1965 | Brandon et al. | 220/510 |
| 3,582,170 | 6/1971 | Schaeffer | 312/140.4 |
| 3,872,976 | 3/1975 | Moore et al. | 312/140.4 X |
| 4,572,598 | 2/1986 | Moore, Jr. | 312/284 |
| 4,768,661 | 9/1988 | Pfeifer | 312/140.4 X |
| 4,802,340 | 2/1989 | Johnson | 62/229 |
| 5,082,334 | 1/1992 | Beyer et al. | 312/140.4 |
| 5,096,056 | 3/1992 | Garcia | 206/45.11 |

*Primary Examiner*—Peter M. Cuomo
*Assistant Examiner*—James O. Hansen
*Attorney, Agent, or Firm*—George F. Bethel; Patience K. Bethel

[57] ABSTRACT

A food bar is formed of a double walled, insulated open chamber and a support grid disposed within the chamber. The support grid is formed of divider bars and cross rails arranged in a pattern across the open chamber of the food bar to divide the opening into compartments for support of food containers and panel inserts. The divider bars have a substantially U-shaped cross section and have spaced apart openings along the top. The cross rails have a substantially U-shaped cross section and have ends which terminate in a downward flange adapted to be received in the openings of the divider bar. A clear panel of material is preferably suspended above the food bar to act as a "sneeze bar".

19 Claims, 4 Drawing Sheets

FOOD BAR WITH MODULAR SUPPORT SYSTEM

BACKGROUND OF THE INVENTION

1. Field of the Invention

This invention relates to the field of food bars for use in restaurants and cafeterias and particularly to a food bar having a unique modular support system for food containers.

2. Description of the Prior Art

Food bars are commonly used in restaurants such as for self-service of salad, soup, and dessert, and in cafeterias and the like. The self-service feature permits large amounts of food to be prepared and kept hot or cold in a ready state for several hours. The food bars can be portable or stationary and often include a means such as hot water for heating or ice for cooling food.

A support system is necessary for holding the pans and bowls containing food to be served. This is commonly in the form of cast or molded openings sized to support the vessel by an outer rim or flange. In most instances the cast or molded openings have a standard size. Therefore, the size of the pan or bowl is set. This is somewhat limiting since some foods are desirably served in larger or smaller than standard stock sizes. Thus, it is desirable to have a support system which can support vessels of differing size and at an economically attractive cost.

Food bars are also commonly provided with a "sneeze guard" which is a panel of glass or clear plastic material disposed above the food at a distance which is high enough to permit access to the food by the hands of a person but low enough to form a barrier between a person's head and hands. The clarity of the glass or plastic gives a view of the food while the barrier provided thereby prevents contamination by coughing or sneezing by a person.

In order to comply with health regulations, the entire food bar and its constituent parts must be thoroughly cleaned on a regular basis to prevent the growth of pathogenic organisms. Thus, it is desirable that a food bar be capable of easy disassembly and provide ready access to all parts. Easy drainage of liquids and wipe up of spills is also desirable.

Moreover, the parts are ideally made from a sturdy material which is easy to clean and is at the same time attractive.

It is an object of the invention to provide a food bar which is made of sturdy materials which are easy to clean.

It is another object of the invention to provide a food bar having a support system for food vessels which is versatile so that different sizes of food vessels or containers, including standard sizes, can be supported and at the same time, the support system is economically attractive.

It is another object of the invention to provide a support system incorporating a plurality of easily assembled and disassembled interlocking divider bars to enable numerous novel combinations and variations to hold food containers.

It is another object of the invention to provide panel inserts containing openings for holding various sized bowls by an outer rim, which panel inserts are sized to fit into compartments defined by the divider bars.

It is a further object of the invention to provide a food bar which incorporates a "sneeze guard" which is effective in blocking contamination and which is at the same time easily assembled and disassembled for convenient and effective cleaning.

SUMMARY OF THE INVENTION

Summarily stated, a food bar supported on a table top or on a cart or trolley is provided by the invention which includes an open, walled, rectangular, box-like member or well. A support grid or framework formed of interlocking, open channel divider bars are arranged across the box-like member in various patterns. These patterns define compartments which hold standard full sized pans or fractional pans or hold panel inserts having openings to hold standard sized salad bowls and smaller round bowls.

The divider bars include open channel members with a narrow top surface having extensions at each end which rest on an interior ledge or rim of the food bar. In particular, the end extensions rest on depressions formed within the rim or ledge of the food bar. The depressions are sized to receive the end extensions. Spaced apart along the narrow top surface of the open channel members are a plurality of slots adapted to receive downward end projections on cross rails.

The divider bars are sturdy, being sized to form a substantial network or grid which can support the weight of filled commercial sized food containers.

In order to further divide the box-like opening within the food bar or cart, there are provided relatively smaller, lighter cross rails. The cross rails have a U-shaped open channel configuration and a narrow top, with end extensions which terminate in downward projections. The downward projections are received in the slots in the top of the divider bars to provide various sized configurations or compartments.

Two clear plastic panels are held within and between two spaced apart A-frame members. One panel is disposed on each side above the food bar to act as a "sneeze guard". A particular advantage of the "sneeze guard" is that it is easily assembled and disassembled for setup and for cleaning.

While the food bar of the invention is primarily described with respect to a food bar supported on a wheeled cart, it should be understood that the invention is not limited thereto. The food bar of the invention can be supported on a table top or counter.

The invention will be more readily understood with reference to the attached drawings taken with the description which follows.

DETAILED DESCRIPTION OF THE INVENTION

Figure 1:
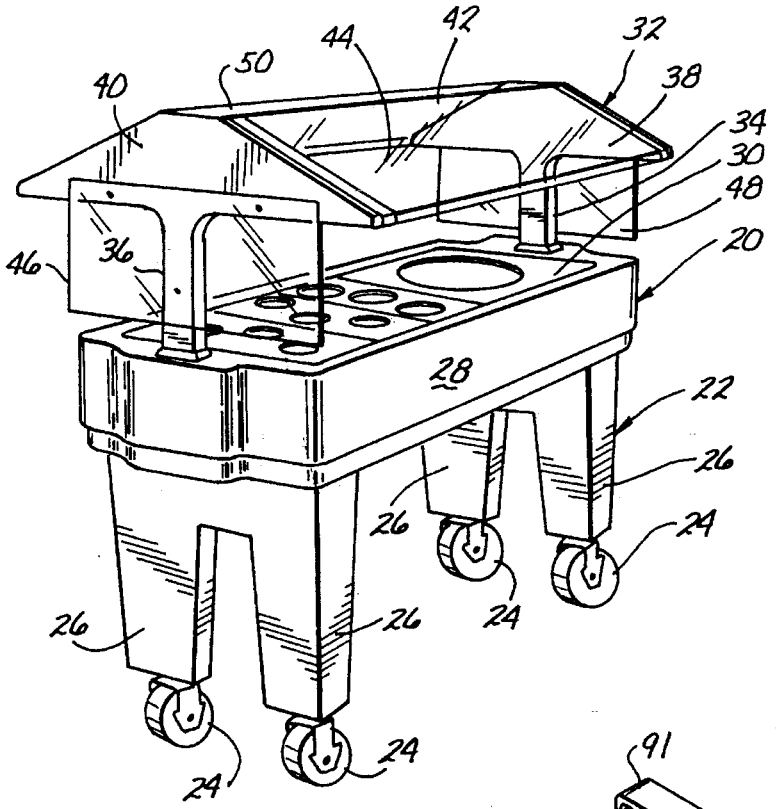
FIG. 1 shows a perspective view of a food bar of the invention supported on a wheeled cart.

Referring now to FIG. 1, there is shown the food bar of the invention which is generally indicated by 20. The food bar 20 is shown being supported on a cart 22 having legs 26 and wheels or casters 24. If desired, the food bar 20 can be supported on a table top or counter.

The food bar 20 is shown with panel inserts 30 supported by a support grid or framework as hereinafter described. A "sneeze guard" 32 is disposed above the food bar 20.

The "sneeze guard" is formed by a pair of stanchions 34 and 36 which support A-frame members 38 and 40 respectively. The A-frame members 38 and 40 include channels or grooves not shown along each sloping edge for accommodating clear panel members 42 and 44. Clear side panel 46 is secured to A-frame member 40 and stanchion 36, and clear side panel 48 is secured to A-frame 38 and stanchion 34.

As shown particularly in FIGS. 2, 3, and 7–12, the food bar 20 includes an open box-like member or well 28 having a bottom or base 52, side walls 54 and 56, and end walls 58 and 60. Side walls 54 and 56 have an inner rim or ledge 62 and 64 respectively which runs the length of the side walls. The rims or ledges 62 and 64 are provided with preset depressions 75. The depressions 75 are preferably aligned between side walls 54 and 56 for easy placement of the divider bars 74 perpendicular to side walls 54 and 56. In this manner, rectangular openings are defined by divider bar 74 for receiving pans or panel inserts.

The end wall 60 has an inner rim or ledge 66 and the end wall 58 has an inner rim or ledge 68. The rim 66 and the rim 68 are spaced deeper than the side wall rims 62 and 64.

The bottom or well 52, side walls 54 and 56, and end walls 58 and 60 are preferably formed as a double wall for strength and for insulation purposes. Preferably, the space 70 within the walls is filled with an insulating foam. This is particularly preferred in order to impart insulation qualities for keeping hot foods hot and cold foods cold. This feature is also important to prevent the growth of food-born bacteria.

Figure 12:
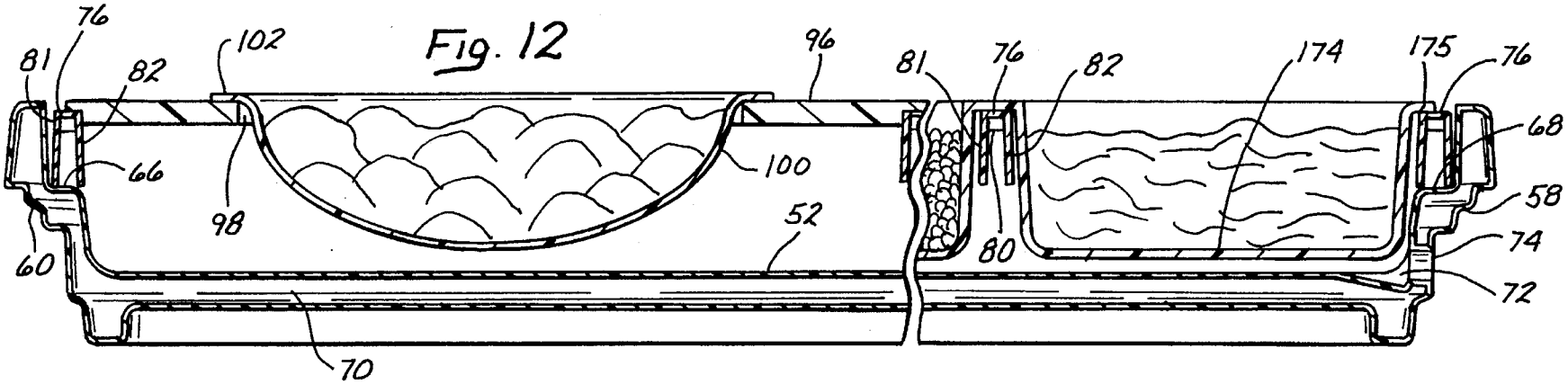
FIG. 12 shows a partially fragmented cross section taken along the lines 12—12 of FIG. 9 and details a salad bowl being held within a salad bowl panel insert and a food pan, both of which are supported within the support grid formed by the divider bars and cross rails.

As shown in FIG. 12, the base of side wall 58 is provided with an opening 72 and plug 77. The opening 72 is utilized for draining the box-like member or well 28 of liquids formed from melted ice and after cleaning.

Figure 3:
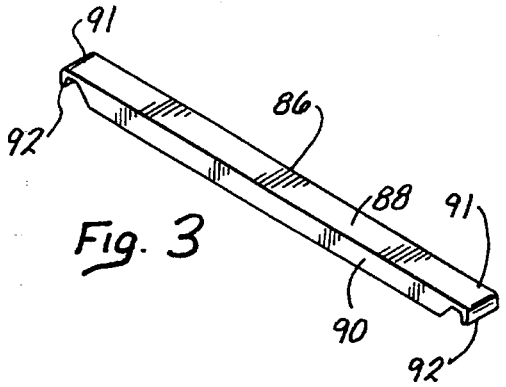
FIG. 3 shows a perspective view of a cross rail of the invention.
Figure 2:
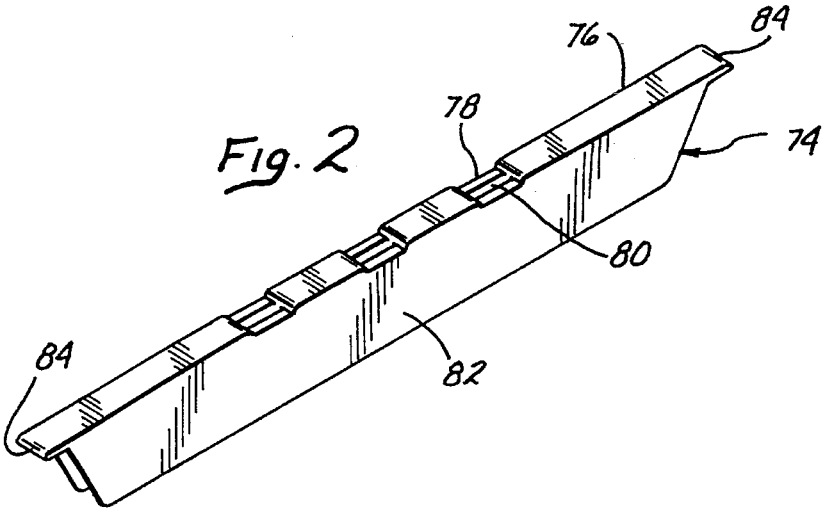
FIG. 2 shows a perspective view of a divider bar of the invention.

The food bar 20 is provided with a framework made up of a grid or network of divider bars 74 as shown in FIG. 2. Cross rails 86 as shown in FIG. 3 also make up the framework or support grid.

Each divider bar 74 is formed of a deep substantially U-shaped open channel member having spaced apart, parallel side walls 81 and 82 which extend at a perpendicular angle from an elongated flat top wall 76. The elongated top wall 76 is provided with depressions 78 having slots 80 therein. The ends of the top wall 76 project beyond the side walls 82 to form extensions 84.

Cross rails 86 are formed of an elongated, flat, narrow top wall 88 and side walls 90 which extend at a perpendicular angle from the top wall 88 to form a shallow U-shaped member. The ends 91 of top wall 88 extend beyond side walls 90 to form a downwardly projecting flange 92. The flange 92 is sized to fit into slots 80 of divider bars 74 to enable interlocking of the cross rails 86 with the divider bars 74 as detailed in FIG. 11.

Slots 80 of divider bar 74 are sized to hold two flanges 92 from two different cross rails 86. In this manner, a grid can be formed for supporting many different sizes and combinations of food pans or panel inserts.

Figure 8:
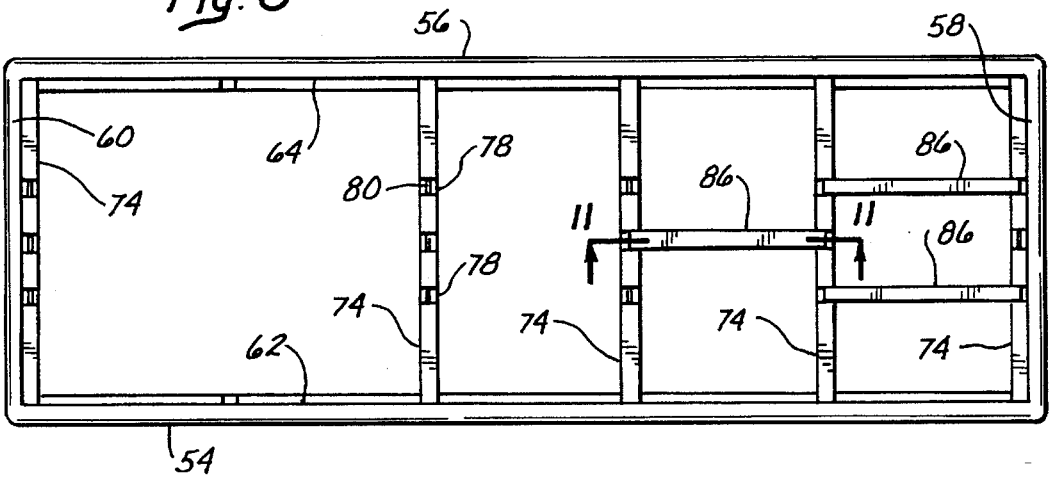
FIG. 8 shows a plurality of divider bars arranged within the food bar of the invention and includes three cross rails arranged across the divider bars.

The slots 80 of divider bars 74 are preferably aligned between parallel divider bars for easy placement of the cross rails 86 perpendicular to the divider bars. In this manner, rectangular openings are defined by divider bars 74, and cross rails 86 as shown in FIG. 8 for receiving fractionally sized pans or containers.

Figure 7:
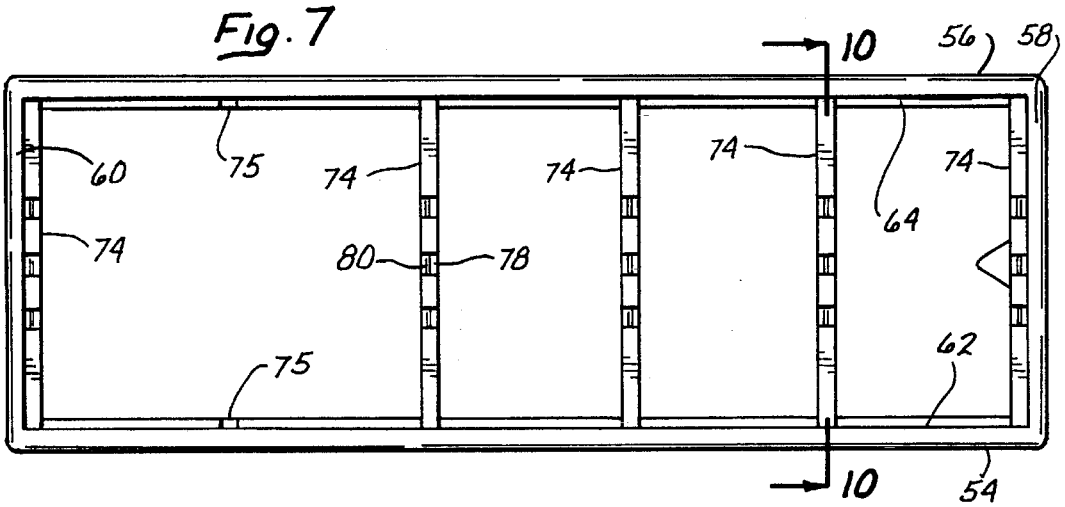
FIG. 7 shows a plurality of divider bars arranged within the food bar of the invention.
Figure 10:
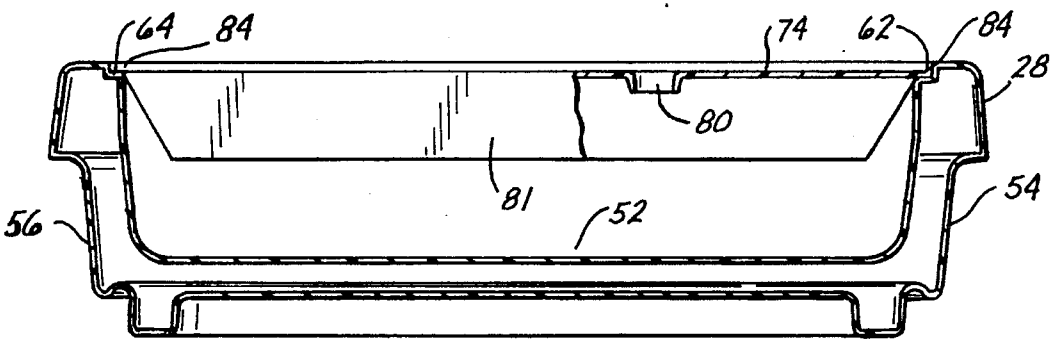
FIG. 10 shows a cross section taken along the lines 10—10 of FIG. 7 and details the slots within the divider bars and shows the ends of the divider bars resting on the interior rim of the food bar.
Figure 11:
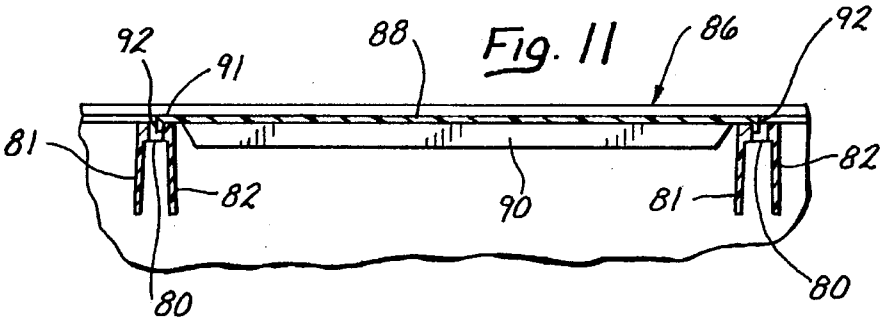
FIG. 11 shows a cross section taken along the lines 11—11 of FIG. 8 and details the interlocking connection between the divider bars and the cross rails.

As shown in FIGS. 7 and 10, divider bars 74 are spaced apart between side walls 54 and 56 of food bar 20. The extensions 84 of divider bars 74 rest within depressions 75 formed within side wall rims 62 and 64. Between the divider bars 74 are arranged cross rails 86 as shown in FIG. 8. The downward projections or flanges 92 of cross rails 86 fit into slots 80 of divider bars 74 as shown in FIG. 11.

As noted above, the divider bars 74 and the cross rails 86 provide a support grid for holding a variety of food service pans, containers, and panel inserts. Several types of panel inserts are shown in FIGS. 4, 5, and 6.

Figure 5:
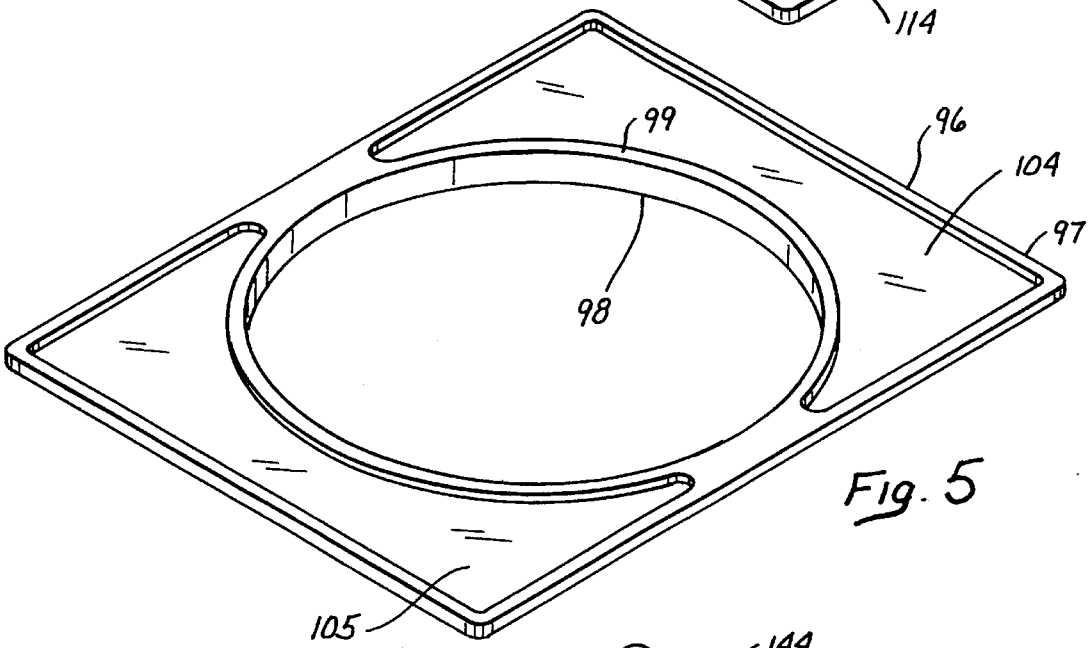
FIG. 5 shows a perspective view of a salad bowl panel insert which can be supported by divider bars held within the food bar of the invention.

FIG. 5 shows a salad bowl panel insert 96 formed as a rectangle having a raised peripheral edge 97 and depressions or recessed areas 104 and 105 that provide a strengthening web. A central opening 98 surrounded by a raised rim 99 forms the support for holding the outer rim 102 of a salad bowl 100 as shown in FIGS. 9 and 12.

Figure 4:
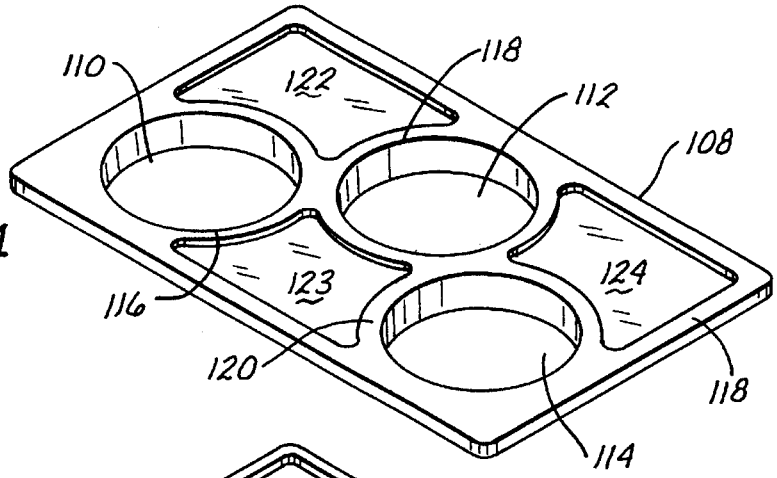
FIG. 4 shows a perspective view of a panel insert which can be supported by divider bars held within the food bar of the invention.

The rectangular shaped panel insert 108 shown in FIG. 4 has three openings 110, 112, and 114 having respective raised rims 116, 118, and 114 for holding bowls or crocks. Recessed areas or depressions 122, 123, and 124 provide a depressed relief or strengthening web to the walls adjacent the openings 110, 112, and 114 and outer peripheral edge 118.

Figure 6:
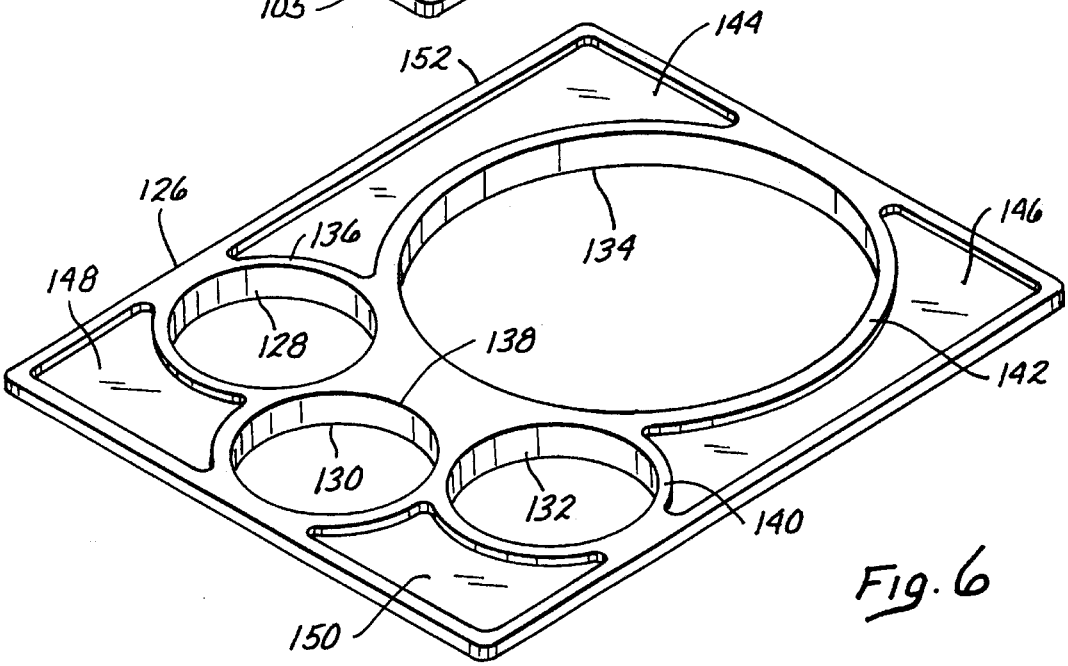
FIG. 6 shows a perspective view of a panel insert for support of a salad bowl and three smaller bowls which can be supported by divider bars held within the food bar of the invention.

The panel insert 126 shown in FIG. 6 has a large opening 134 for a salad bowl and three smaller openings 128, 130, and 132 for holding bowls or crocks. Recessed areas, webs, or depressions 144, 146, 148, and 150 give a raised surround 136, 138, 140, and 142 to openings 128, 130, 132, and 134 as well as to the peripheral edge region 152. These depressions or webs 144, 146, 148 and 150 again provide strength to the cross sectional structure.

Figure 9:
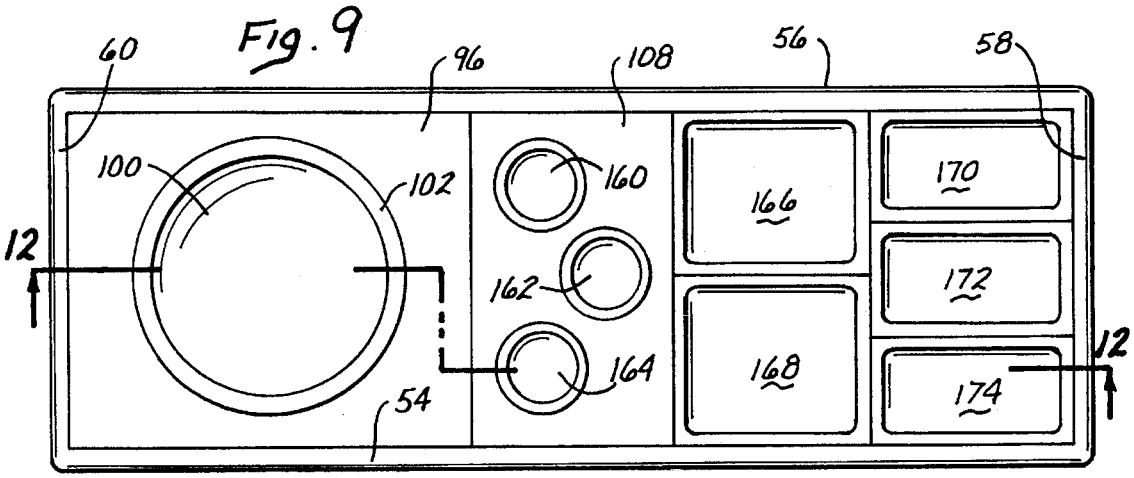
FIG. 9 shows the food bar of FIG. 8 with the addition of two panel inserts and several food pans being supported within the food bar support grid.

FIG. 9 shows the panel insert 108 of FIG. 4 and the panel insert 96 of FIG. 5 supported on the divider bars 74. FIG. 12 shows a salad bowl 100 being supported by its rim 102 on panel insert 96.

FIG. 9 also shows food pans 166, 168, 170, 172, and 174 being supported on the divider bars 74 and cross rails 86 which are arranged according to the showing of FIG. 8.

The detailed cross section of FIG. 12 shows the food pan 174 being supported by its rim 175 on top surface 76 of divider bars 74. A salad bowl panel insert 96 is shown supported by its peripheral edge 97. A salad bowl 100 is supported within panel insert 96 by its peripheral rim 102.

FIG. 10 shows a detailed showing of a divider bar 74 revealing a partially broken away cross section of a slot 80 within a divider bar. It can be seen that the ends 84 of the divider bar 74 rest on the interior rims 62 and 64 of side walls 56 and 54 of the food bar 20.

FIG. 11 shows a detailed cross section of the interlocking connection between the divider bars 74 and the cross rails 86. The downward projection 92 of cross rail 86 fits into the slot 80 of divider bar 86 to form the grid or framework shown in FIG. 8.

FIG. 12 shows a partially fragmented cross section taken along the lines 12—12 of FIG. 9 and details a salad bowl being held within a salad bowl panel insert and a food pan, both of which are supported within the support grid formed by the divider bars and cross rails.

Preferably, the food bar is formed of a high density rotationally molded polyethylene. Alternately, the food bar can be made by injection molding or by other methods which are less preferred. The clear panels for the "sneeze guard" are preferably made of a clear polyacrylic material. The panel inserts for the food bar are preferably made of an injection molded styrene, polycarbonate, nylon or SAN polystyrene.

The food bar of the invention thus provides an insulated box or well having a network or grillwork of divider bars and cross rails which can be arranged to divide the food bar into variously sized compartments or openings. These compartments can be utilized to hold standard sized food pans or to hold panel inserts having openings for special food containers. A "sneeze guard" can be suspended above the food bar box or well to protect the interior of the food bar from contamination by sneezes or coughs of the users.

Various modifications of the invention are contemplated and can be resorted to without departing from the spirit and scope of the invention as defined by the following claims.

We claim:

1. A food bar comprising:

a chamber defined by a bottom wall and side walls and having a top opening therein; and, a plurality of divider bars arranged across said top opening of said chamber to form a grid for support of food containers and panel inserts;

said divider bars comprising:

an elongated member having a substantially U-shaped cross section defined by a top wall, and two skirt walls extending downwardly from said top wall, said top wall having ends which extend beyond said skirt walls for resting on said side walls of said chamber; and, at least one opening spaced along said top wall of said divider bar.

2. A food bar according to claim 1 wherein:

said at least one opening is disposed within a recessed area of said top wall of said divider bars.

3. A food bar according to claim 2 further comprising:

cross rails formed of elongated members having a substantially U-shaped cross section defined by a top wall and two skirt walls extending downwardly from said top wall, said top wall having ends which extend beyond said skirt walls and which terminate in a downward flange adapted to be received in said at least one opening of said divider bar.

4. A food bar according to claim 3 wherein said food bar further comprises:

an inner peripheral ledge disposed within said side walls of said chamber for support of said ends of said top wall of said divider bars.

5. A food bar according to claim 4 wherein said ledge further comprises:

depressions within said ledge for receiving said ends of said top wall of said divider bars for aligning said divider bars within said food bar.

6. A food bar according to claim 3 wherein:

said at least one opening within said divider bars is sized to receive two downward flanges from separate cross rails.

7. A food bar according to claim 6 wherein:

said top opening of said chamber of said food bar is substantially rectangular in configuration.

8. A food bar according to claim 7 further comprising:

a panel of clear material spaced above said food bar and means attached to said food bar for supporting said panel of clear material.

9. A food bar according to claim 3 wherein:

said divider bars and cross rails are comprised of a plastic.

10. A support grid for a food bar having an opening therein comprising:

a plurality of divider bars and a plurality of cross rails for arrangement across the opening to divide the opening into compartments for support of food containers and panel inserts;

said divider bars comprising lengths of material having a substantially U-shaped cross section defined by a top wall, and two skirt walls extending downwardly from said top wall, said top wall having ends which extend beyond said skirt walls and having at least one opening within said top wall and spaced apart along said top wall of said divider bar; and, said cross rails comprising lengths of material having a substantially U-shaped cross section defined by a top wall and two skirt walls extending downwardly from said top wall, said top wall having ends which extend beyond said skirt walls and which terminate in a downward flange adapted to be received in said at least one opening of said bar.

11. A support grid for a food bar according to claim 10 wherein:

said at least one opening within said top wall of said divider bars is sized to accommodate the downward flange of two separate cross rails.

12. A support grid for a food bar according to claim 11 wherein:

said at least one opening of said top wall of said divider bars is disposed within a recessed area.

13. A support grid for a food bar according to claim 10, wherein:

said support grid is comprised of a plastic.

14. A food bar comprising in combination, a chamber having an opening therein and a support grid disposed within said opening of said chamber for support of food containers and panel inserts, said support grid comprising:

a plurality of divider bars and a plurality of cross rails arranged across said opening of said chamber of said food bar to form a grid which divides the opening into compartments for support of food containers and panel inserts;

said divider bars comprising lengths of material having a substantially U-shaped cross section defined by a top wall, and two skirt walls extending downwardly from said top wall, said top wall having ends which extend beyond said skirt walls and having at least one opening within said top wall and spaced apart along said top wall of said bar; and, said cross rails comprising lengths of material having a substantially U-shaped cross section defined by a top wall and two skirt walls extending downwardly from said top wall, said top wall having ends which extend beyond said skirt walls and which terminate in a downward flange adapted to be received in said at least one opening of said bar.

15. A food bar according to claim 14 wherein:

said chamber is comprised of a double walled chamber having double walls forming said bottom wall and double walls forming said side walls with insulation disposed within said double walls.

16. A food bar according to claim 15 wherein:

said chamber further comprises an inner ledge within said side walls for support of said divider bars.

17. A food bar according to claim 16 wherein:

said inner ledge further comprises depressions spaced around said inner ledge for holding the ends of said divider bars in a preestablished pattern.

18. A food bar according to claim 17 wherein:

said food bar and said support grid are formed of a plastic and wherein said opening within said chamber of said food bar has a substantially rectangular configuration.

19. A food bar according to claim 18 further comprising:

at least one clear panel of material spaced above said support grid; and, means attached to said food bar for support of said at least one clear panel of material.

* * * * *